US005282872A

United States Patent [19]

Oppenlaender et al.

[11] Patent Number: 5,282,872

[45] **Date of Patent: * Feb. 1, 1994**

[54] FUEL FOR OTTO-CYCLE ENGINES

[75] Inventors: Knut Oppenlaender, Ludwigshafen; Brigitte Wegner, Speyer; Juergen Mohr, Gruenstadt; Roland Schwen, Friedelsheim; Klaus Barthold, Mannheim; Juergen Thomas, Fussgoenheim, all of Fed. Rep. of Germany

[73] Assignee: BASF Aktiengesellschaft, Ludwigshafen, Fed. Rep. of Germany

[ * ] Notice: The portion of the term of this patent subsequent to Dec. 10, 2008, has been disclaimed.

[21] Appl. No.: 970,958

[22] Filed: Nov. 3, 1992

Related U.S. Application Data

[63] Continuation of Ser. No. 638,578, Jan. 8, 1991, abandoned.

[30] Foreign Application Priority Data

Jan. 10, 1990 [DE] Fed. Rep. of Germany ..... 4000539

[51] Int. Cl.[5] ..... C10L 1/22

[52] U.S. Cl. ..... 44/403; 44/405; 44/406; 44/407; 44/408; 44/419

[58] Field of Search ..... 44/403, 405, 406, 407, 44/408, 419

[56] References Cited

U.S. PATENT DOCUMENTS

| | | | |
|---|---|---|---|
| 2,805,203 | 9/1957 | Knapp et al. | 44/403 |
| 2,830,019 | 4/1958 | Fields et al. | 44/403 |
| 3,055,749 | 9/1962 | McDermott | 44/403 |
| 3,166,387 | 1/1965 | Ebner | 44/403 |
| 3,173,770 | 3/1965 | Thompson et al. | 44/407 |
| 3,202,491 | 8/1965 | Maxwell et al. | 44/407 |
| 3,240,701 | 3/1966 | Furia | 44/403 |
| 3,407,051 | 10/1968 | Thompson et al. | 44/407 |
| 3,449,097 | 6/1969 | Andress, Jr. | 44/403 |
| 4,871,375 | 10/1989 | Martischius et al. | 44/403 |
| 5,071,445 | 12/1991 | Oppenlaender et al. | 44/419 |

FOREIGN PATENT DOCUMENTS 2624630 12/1977 Fed. Rep. of Germany .

*Primary Examiner*—Jerry D. Johnson
*Attorney, Agent, or Firm*—Keil & Weinkauf

[57] ABSTRACT

An Otto-cycle engine fuel containing a small amount of an amide, amide/ammonium salt and/or ammonium salt of an aminoalkylene polycarboxylic acid and a long-chain secondary amine as additive for cleaning the carburetor and valves.

7 Claims, No Drawings

FUEL FOR OTTO-CYCLE ENGINES

This application is a continuation of application Ser. No. 07/638,578, filed on Jan. 8, 1991, now abandoned.

The present invention relates to an Otto-cycle engine fuel containing a minor amount of an amide of an aminoalkylene polycarboxylic acid and a secondary long-chain amine.

The carburetor and suction system in Otto-cycle engines and also the injection system for metering fuel in Otto-cycle and diesel engines are becoming more and more contaminated by dust particles from the air, by unburned hydrocarbon residues from the combustion chamber and by crankcase breather gases sucked into the carburetor.

When the engine runs under no-load or low-load conditions, these residues effect a shift in the air/fuel ratio to produce a richer mixture. The result is less complete fuel combustion, which in turn increases the proportion of unburned or partially burned hydrocarbons in the exhaust and effects a rise in fuel consumption.

A known method of overcoming such drawbacks is to use fuel additives designed to keep valves, carburetors and injection systems clean (cf., for example, M. Rossenbeck in Karalysacoren, Tenside, Mineralöladditive, edited by J. Falbe and U. Hasserodt, pp. 223 et seq., G. Thieme Verlag, Stuttgart 1978).

At present, such detergent additives are divided into two generations depending on their action and their preferential locus of action.

The first additive generation was only capable of preventing new deposits in the suction system without being able to remove old deposits, whilst modern additives of the second generation can do both ("keep-clean" and "clean-up"effects) and are particularly effective, due to changed thermal properties, in high-temperature zones, i.e. at the inlet valves.

The principle underlying the molecular structure of fuel detergents may be generalized as the linkage of polar structures with non-polar or lipophilic radicals usually of relatively high molecular weight.

Particularly useful representatives of the second generation of additives are, in addition to products based on polyisobutenes, e.g. polyisobutylamine as described in DE-OS 3,611,230, and in particular amides, imides and combined imide/amides of various carboxylic acids and polycarboxylic acids.

Particularly noteworthy in this respect are the known active ingredients based on trilon derivatives and higher branched amines as described in EP-A2 006,527.

We have now found, surprisingly, that a particularly good carburetor and valve cleaning effect is achieved when a fuel for Otto-cycle engines contains, in a concentration of from 100 to 500 ppm, an amide, an amide-/ammonium salt or an ammonium salt of an aminoalkylene polycarboxylic acid and a secondary fatty amine or a mixture thereof of the formulae I and II

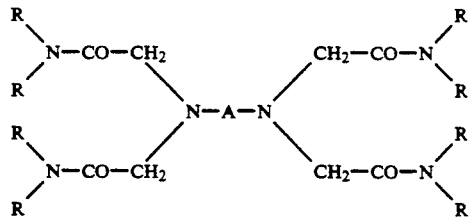

(I)

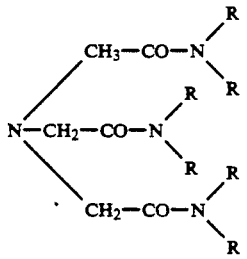

(II)

in which

A is a straight-chain or branched-chain alkylene radical of from 2 to 6 carbon atoms or a radical of the formula

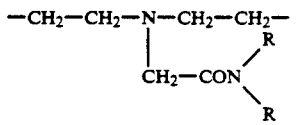

and

R denotes substantially straight-chain aliphatic radicals, particularly $C_{10}$–$C_{30}$-alkyl and preferably $C_{14}$–$C_{24}$-alkyl, and some or all of the amide structures may be in the form of ammonium structures of the formula

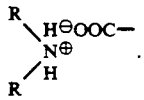

The amides or amide/ammonium salts or ammonium salts of, for example, ni-trilotriacetic acid, ethylenediaminotetraacetic acid or propylene-1,2-diaminotetraacetic acid are obtained by reacting the acid with from 0.5 to 1.5, preferably 0.8 to 1.2, moles of amine per carboxyl group.

The reaction temperature is between approx. 80° and 200° C., and to prepare the amides, continuous removal of the water of reaction is required. However, complete conversion to amide is not necessary and it is highly acceptable for from 0% to 100% molar of the amine reacted to be converted to the ammonium salt.

Suitable amines of the formula

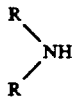

are, in particular, dialkylamines in which R is a straight-chain $C_{10}$–$C_{30}$-and preferably $C_{14}$–$C_{24}$-alkyl radical. Specific examples are dioleylamine, dipalmitinamine, dicoconut fatty amine, dibehenylamine and, preferably, ditallow fatty amine.

The amides or ammonium salts of aminoalkylene polycarboxylic acids of formulae I and II to be used in the present invention are added to the fuel in an amount of from 50 to 1000 ppm and preferably from 100 to 500 ppm.

A suitable Otto-cycle engine fuel is a leaded or unleaded normal or super gasoline. Such gasoline may contain components other than hydrocarbons, for example alcohols such as methanol, ethanol and t-butanol or ethers such as methyl-t-butyl ether. In addition to the amides of aminoalkylene polycarboxylic acids to be used in accordance with the present invention, the fuel will usually contain further additives such as corrosion inhibitors, stabilizers, antioxidants and/or detergents.

Corrosion inhibitors are usually ammonium salts of organic carboxylic acids showing a tendency to film formation due to an appropriate structure of the parent compounds. Amines are also frequently present in corrosion inhibitors to lower their pH. Corrosion inhibitors for non-ferrous metals usually comprise heterocyclic aromatics.

Examples of antioxidants or stabilizers are, in particular, amines such as para-phenylenediamine, dicyclohexylamine, morpholine or derivatives of said amines. Phenolic antioxidants such as 2,4-di-t-butylphenol or 3,5-di-t-butyl-4-hydroxyphenyl propionic acid and derivatives thereof are also added to fuels and lubricants.

Other carburetor, injector and valve detergents which may be present in the fuel are, for example, amides and imides of polyisobutylene succinaldehyde, polybutene polyamines and long-chain carboxamides and long-chain carboximides.

EXAMPLES

A) Preparation of amides of nitriloacetic acids 1) 240 g (0.48 mole) of ditallow fatty amine and 35 g (0.12 mole) of ethylenediaminotetraacetic acid were melted and heated at 190° C. while the resulting water of reaction was distilled off continuously. The reaction was stopped after running for about 25 hours, at which point the acid number was <5 and the amine number was <1.1. A water jet vacuum was applied for 2 hours at 120° C. to complete the removal of the water of reaction. There were obtained 265 g of a brown waxy solid, which can be dissolved in, say, xylene for easier handling.

2) 100 g (0.2 mole) of ditallow fatty amine and 14.6 g (0.05 mole) of ethylenediaminotetraacetic acid were heated at 180° C. for 8 hours, at which point some 50% of the amine had broken down to the amide (acid number 45.8, theory =49.7). There were obtained 97.6 g of the amide/ammonium salt as a light-brown waxy solid.

3) To a melt of 229.5 g (0.45 mole) of ditallow fatty amine were added 28.65 g (0.15 mole) of nitrilotriacetic acid (trilon A) at 80° C. The reaction mixture was then heated at 180–190° C. for 10 hours. To effect total removal of the water of reaction, the product was dried for a further 2 hours at 120° C. under a water jet vacuum. There were obtained 249 g (theory =250 g) of a light-brown waxy solid.

B) Tests on valve-cleaning properties

| Product | Deposits [mg]* on valve No. 1 | 2 | 3 | 4 |
|---|---|---|---|---|
| Polyisobutylamine | 3 | 0 | 2 | 1 |

-continued

| Product | Deposits [mg]* on valve No. 1 | 2 | 3 | 4 |
|---|---|---|---|---|
| (DE-OS 3,611,230) Example (A) (1) | 44 | 0 | 0 | 0 |

*measured as specified in CEC-F-02-T-79

We claim:

1. A fuel for Otto-cycle engines containing, in a detergent effective concentration, an amide of an aminoalkylene polycarboxylic acid of formula I or II

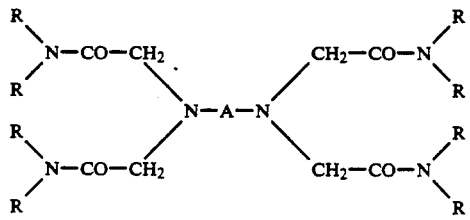

(I)

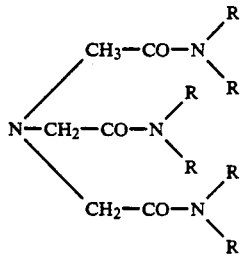

(II)

or a mixture thereof, or a corresponding amide/ammonium salt of said polycarboxylic, acid wherein one or more, but not all of the amide groups are in the form of a dialkylammonium carboxylate group, in which A is a straight-chain or branched-chain alkylene radical of from 2 to 6 carbon atoms or a radical of the formula

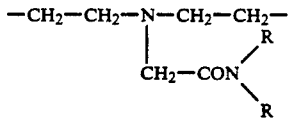

and R denotes a straight-chain $C_{12}$–$C_{24}$-alkyl radical.

2. A fuel as claimed in claim 1, containing one or more compounds of the formulae I and II, in which

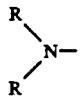

denotes a ditallow fatty amine radical.

3. A fuel as claimed in claim 1, characterized in that it contains other fuel detergents, anticers, corrosion inhibitors and/or antioxidants.

4. A fuel as claimed in claim 1, containing one or more compounds of the formula

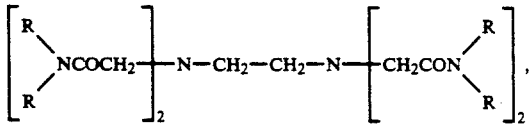

in which R is a straight-chain $C^{14}$–$C_{24}$ radical, and some of the amide groups are present in the form of dialkylammonium carboxylate groups of amines of the formula

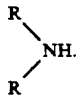

5. A fuel as claimed in claim 4, containing one or more compounds of the formulae I and II, in which

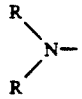

denotes a ditallow fatty amine radical.

6. A fuel as claimed in claim 1 and containing the compounds of formulae I and II in concentrations of from 50 to 1500 ppm, based on the fuel.

7. A fuel as claimed in claim 6, containing one or more compounds of the formulae I and II, in which

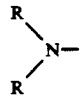

denotes a ditallow fatty amine radical.

* * * * *